US009680226B2

(12) United States Patent
Hashimoto et al.

(10) Patent No.: US 9,680,226 B2
(45) Date of Patent: Jun. 13, 2017

(54) ANTENNA DEVICE AND WIRELESS DEVICE

(71) Applicant: KABUSHIKI KAISHA TOSHIBA, Tokyo (JP)

(72) Inventors: Koh Hashimoto, Kanagawa (JP); Makoto Higaki, Tokyo (JP); Manabu Mukai, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 81 days.

(21) Appl. No.: 14/701,593

(22) Filed: May 1, 2015

(65) Prior Publication Data

US 2015/0364823 A1 Dec. 17, 2015

(30) Foreign Application Priority Data

Jun. 17, 2014 (JP) ..... 2014-124469

(51) Int. Cl.
*H01Q 1/38* (2006.01)
*H01Q 9/04* (2006.01)
(Continued)

(52) U.S. Cl.
CPC ..... *H01Q 9/0407* (2013.01); *H01Q 1/38* (2013.01); *H01Q 1/48* (2013.01); *H01Q 9/045* (2013.01);
(Continued)

(58) Field of Classification Search
CPC ..... H01Q 13/106; H01Q 1/38; H01Q 13/10; H01Q 9/0407; H01Q 13/08; H01Q 9/045;
(Continued)

(56) References Cited

U.S. PATENT DOCUMENTS 5,594,455 A * 1/1997 Hori ..... H01Q 9/0414 343/700 MS
6,091,366 A * 7/2000 Zhang ..... H01Q 1/38 343/700 MS
(Continued)

FOREIGN PATENT DOCUMENTS

JP 02-79603 6/1990
JP H02-79603 U 6/1990
(Continued)

OTHER PUBLICATIONS

Machine Translation of JP 2001-102747.*
(Continued)

*Primary Examiner* — Tho G Phan
(74) *Attorney, Agent, or Firm* — Finnegan, Henderson, Farabow, Garrett & Dunner, L.L.P.

(57) ABSTRACT

According to an embodiment, the antenna device includes a substrate, a through hole, first and second grounded conductors, a radiating element and a feeder line. The substrate includes first to third layers. The third layer is formed between the first and the second layers. The through hole is formed on a substrate. The first grounded conductor is formed in the first layer and has a gap positioned between the first grounded conductor and the through hole. The second grounded conductor is formed in the second layer. The radiating element transmits or receives linearly-polarized waves. The feeder line is formed in the third layer, and is electrically continuous with the through hole. The feeder line includes a straight line that is formed in the third layer in an area of projection of the gap in thickness direction of the substrate and that is formed to be substantially parallel to a plane of polarization of the linearly-polarized waves.

19 Claims, 7 Drawing Sheets

(51) Int. Cl.
*H01Q 1/48* (2006.01)
*H01Q 13/10* (2006.01)
*H01Q 21/06* (2006.01)

(52) U.S. Cl.
CPC ..... *H01Q 13/106* (2013.01); *H01Q 21/064* (2013.01)

(58) Field of Classification Search
CPC ..... H01Q 1/48; H01Q 21/064; H01R 24/02; H01R 17/04; H05K 3/46; H01P 5/02
USPC ..... 343/700 MS, 702, 846, 848, 853
See application file for complete search history.

(56) References Cited

U.S. PATENT DOCUMENTS 6,937,193 B2 8/2005 Hendler et al.
7,675,465 B2 * 3/2010 Doan ..... H01Q 1/38 343/700 MS
7,936,306 B2 * 5/2011 Mierke ..... H01Q 9/0414 343/700 MS
2010/0090903 A1 4/2010 Byun et al.
2012/0212384 A1 * 8/2012 Kam ..... H01Q 1/2283 343/767

FOREIGN PATENT DOCUMENTS

JP 2001-102747 4/2001
JP 2001-267833 9/2001

OTHER PUBLICATIONS

Machine Translation of JP 2001-267833.*
Extended European Search Report issued by the European Patent Office on Nov. 17, 2015, for European Patent Application No. 15164204.8.

* cited by examiner

ANTENNA DEVICE AND WIRELESS DEVICE

CROSS-REFERENCE TO RELATED APPLICATION(S)

This application is based upon and claims the benefit of priority from Japanese Patent Application No. 2014-124469, filed on Jun. 17, 2014; the entire contents of which are incorporated herein by reference.

FIELD

Embodiments described herein relate generally to an antenna device and a wireless device.

BACKGROUND

Typically, an antenna device is known in which electrical power to a radiating element, which is formed on a circuit board, is fed using a coaxial line or a coaxial connector having a coaxial structure and installed on the outside of the circuit board. In such an antenna device, electrical power to a radiating element is fed by establishing electrical continuity between an inner electrical conductor of the coaxial line and the signal line of a stripline.

Regarding a method for establishing electrical continuity between the coaxial line and the stripline; a method is known in which, for example, electrical continuity between the inner electrical conductor of the coaxial line and the signal line of the stripline is established using a non-through via hole formed on the circuit board. There is another method in which electrical continuity between the inner electrical conductor of the coaxial line and the signal line of the stripline is established using a through hole formed in a penetrating manner on the circuit board.

However, in the conventional via-hole-based method of establishing electrical continuity; since a non-through via hole is formed, it results in an increase in the manufacturing cost. Moreover, in the conventional through-hole-based method of establishing electrical continuity, it is necessary to keep a gap between the through hole and a grounded conductor. For that reason, in the through-hole-based method of establishing electrical continuity, the communication quality of the antenna device decreases in consequence of the leakage of radio waves through the gap.

DETAILED DESCRIPTION

According to an embodiment, the antenna device comprises a through hole, a first grounded conductor, a second grounded conductor, a radiating element and a feeder line. The through hole is formed in a penetrating manner on a substrate. The first grounded conductor is formed in a first layer of the substrate and has a gap, the gap being positioned between the first grounded conductor and one end of the through hole. The second grounded conductor is formed in a second layer of the substrate. The radiating element is formed on the substrate and transmits or receives linearly-polarized waves. The feeder line is formed in a third layer which is an inner layer of the substrate and which is formed in between the first layer and the second layer. The feeder line is electrically continuous with the through hole. The feeder line feeds electrical power to the radiating element. The feeder line includes a straight line that is formed in the third layer in an area of projection of the gap in thickness direction of the substrate and that is formed to be substantially parallel to a plane of polarization of the linearly-polarized waves.

Various embodiments will be described in detail below with reference to the accompanying drawings.

First Embodiment

Figure 1A:
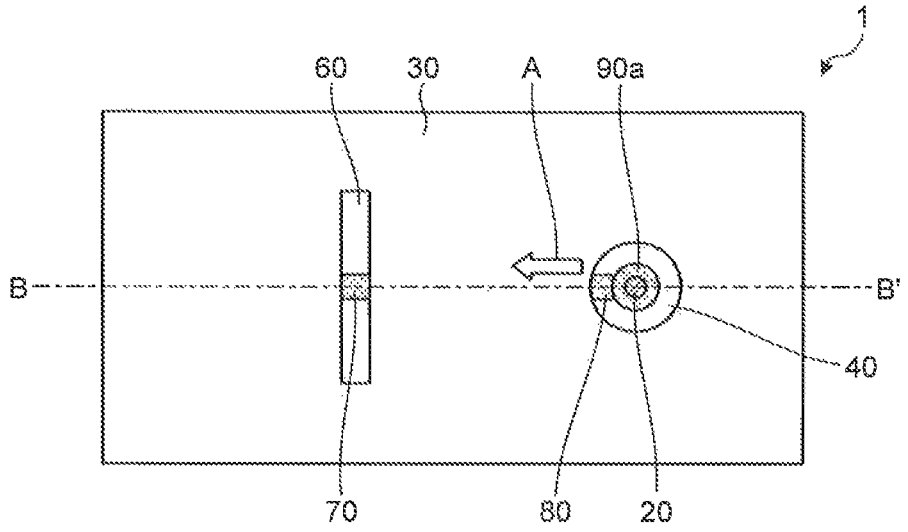
FIG. 1A is a top view of a configuration of an antenna device according to a first embodiment.
Figure 1B:
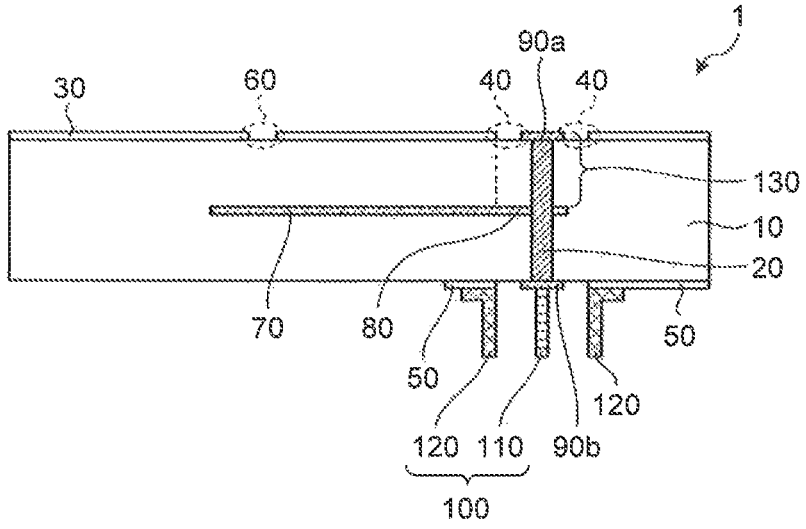
FIG. 1B is a cross-sectional view of the configuration of the antenna device according to the first embodiment.

FIG. 1 is a diagram illustrating a configuration of an antenna device 1 according to a first embodiment. FIG. 1A is a top view of the antenna device 1 according to the first embodiment. FIG. 1B is a cross-sectional view of the antenna device 1 along a dashed-dotted line B-B' illustrated in FIG. 1A.

The antenna device 1 includes a substrate 10; a through hole 20 that is formed in a penetrating manner on the substrate 10; a first grounded conductor 30 formed in a first layer of the substrate 10; and a second grounded conductor 50 formed in a second layer of the substrate 10. Moreover, the antenna device 1 includes a radiating element 60 formed on the substrate 10; and a feeder line 70 that feeds electrical power to the radiating element 60. Furthermore, the antenna device 1 includes land portions 90*a* and 90*b*.

The substrate 10 is a multi-layer substrate having a plurality of layers. In the first embodiment, the substrate 10 has a first layer and a second layer as the outer layers, and has a third layer (not illustrated) as an inner layer. In between the first layer and the third layer as well as in between the second layer and the third layer, an insulation layer (not illustrated) is formed that is made of resin or ceramic.

The through hole 20 is formed in a penetrating manner on the substrate 10. The land portion 90*a* is connected to one end of the through hole 20 and is formed in the first layer, which is an outer surface of the substrate 10, on the inside of a gap 40. The land portion 90*b* is connected to the other end of the through hole 20 and is formed in the second layer that is an outer surface of the substrate 10.

The first grounded conductor 30 is formed in the first layer of the substrate 10, and has the gap 40 with one end of the through hole 20. As illustrated in FIG. 1A, the first grounded conductor 30 has a round hole formed thereon, and one end of the through hole 20 is formed on the inside of that round hole.

The second grounded conductor 50 is formed in the second layer of the substrate 10. Moreover, the second grounded conductor 50 is formed to enclose the other end of the through hole 20. The radiating element 60 is formed in the first layer of the substrate 10. In the first embodiment, the radiating element 60 is a slit formed in the first grounded conductor 30. As illustrated in FIG. 1A, the radiating element 60 is an oblong slot in which the side perpendicular to the dashed-dotted line B-B' represents the long side. Moreover, the radiating element 60 transmits or receives linearly-polarized waves having the plane of polarization substantially parallel to the dashed-dotted line B-B'.

The feeder line 70 is a signal line formed in the third layer that is formed in between the first layer and the second layer of the substrate 10. The feeder line 70 is electrically continuous with the through hole 20, and feeds electrical power to the radiating element 60. Moreover, the feeder line 70 has a straight line 80 that is formed in the third layer in an area of projection of the gap in the thickness direction of the substrate 10. The straight line 80 is formed substantially parallel to the plane of polarization of the linearly-polarized waves transmitted and received by the radiating element 60.

In the portion in which the through hole 20 and the feeder line 70 are electrically continuous, it is possible to have a land portion (not illustrated). Moreover, the second grounded conductor 50 may be disposed in an inner layer instead of an outer layer. In that case, the second grounded conductor 50 may be positioned on the side of the first layer with respect to the feeder line 70.

To the antenna device 1, a coaxial line 100 is connected. The coaxial line 100 includes an inner electrical conductor 110 and an outer electrical conductor 120. The inner electrical conductor 110 is electrically connected to the through hole 20 via the land portion 90*b* by means of soldering. The outer electrical conductor 120 is electrically connected to the second grounded conductor 50 by means of soldering. Herein, the inner part of the through hole 20 may be filled with resin so that the solder, which is used in connecting the coaxial line 100 and the antenna device 1, is prevented from running down from the through hole 20.

There is given the operating principle of the antenna device 1. In the antenna device 1 according to the first embodiment, the gap 40 is formed between one end of the through hole 20 and the first grounded conductor 30. As a result, in the antenna device 1, excellent matching characteristics can be achieved in high-frequency zones. However, the radio waves flowing through the straight line 80 leak from the gap 40.

Herein, the radiating element 60 is an antenna that sends and receives linearly-polarized waves. Thus, if the radio waves transmitted and received by the radiating element 60 overlap with radio waves having a different plane of polarization, then the cross polarization discrimination decreases thereby decreasing the communication quality of the antenna device 1.

In that regard, in the antenna device 1 according to the first embodiment, the straight line 80 is formed to be parallel with the plane of polarization of the linearly-polarized waves so that the electrical field of the radio waves leaking from the gap 40 has the orientation (in FIG. 1A, an arrow A) in the substantially parallel direction to the plane of polarization. As a result, the plane of polarization of the radio waves leaking from the gap 40 and the plane of polarization of the linearly-polarized waves transmitted and received by the radiating element 60 can be kept substantially parallel to each other. For that reason, the antenna device 1 can transmit and receive radio waves without causing a decrease in the cross polarization discrimination.

In this way, in the antenna device 1 according to the first embodiment, the cross polarization discrimination is prevented from a decrease by ensuring that the electrical field of the radio waves leaking from the gap 40 has the orientation (in FIG. 1A, the arrow A) in the substantially parallel direction to the plane of polarization. That enables achieving enhancement in the communication quality of the antenna device 1. Because of the through hole 20 formed in a penetrating manner on the substrate 10, the antenna device 1 is connected to the coaxial line 100. hence, the antenna device 1 can be manufactured with ease, thereby enabling achieving reduction in the manufacturing cost.

First Modification Example

Figure 2:
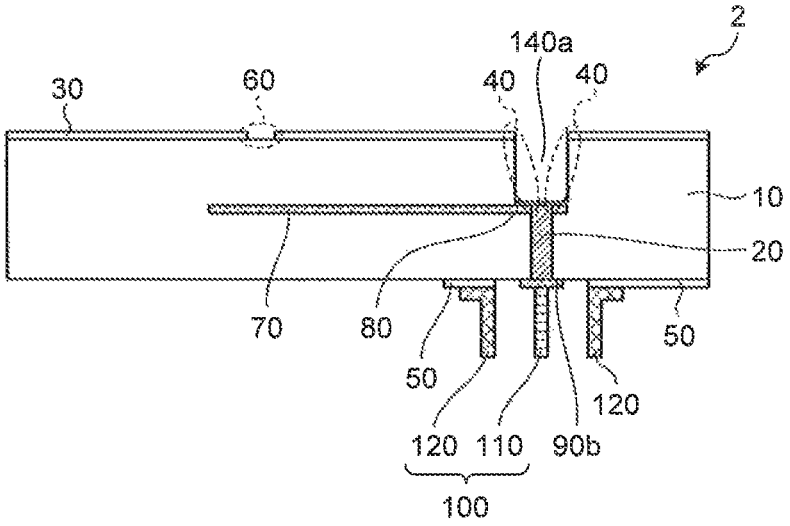
FIG. 2 is a cross-sectional view of an antenna device according to a first modification example of the first embodiment.

Explained below with reference to FIG. 2 is a first modification example of the antenna device 1 according to the first embodiment. In the first modification example, because an antenna device 2 is the same as the antenna device 1 illustrated in FIG. 1A when viewed from the above, the top view of the antenna device 2 is not illustrated. FIG. 2 is a cross-sectional view of the antenna device 2 along the dashed-dotted line B-B' illustrated in FIG. 1A. Herein, the constituent elements same to the first embodiment are referred to by the same reference numerals, and the relevant explanation is omitted.

As illustrated in FIG. 2, the antenna device 2 according to the first modification example includes a recessed portion 140*a*, which is formed by digging a hole in the first grounded conductor 30 in the thickness direction of the substrate 10. Namely, a hole is formed in the insulation layer which is formed in between the first layer and the third layer.

There is given the explanation of a via hole 130 that, in the through hole 20 illustrated in FIG. 1B, is formed on the side of the first layer of the substrate 10 with respect to the feeder line 70. In the through hole 20, the via hole 130 is equivalent to the portion formed within the insulation layer which is formed in between the first layer and the second layer of the substrate 10.

Thus, with respect to the feeder line 70, the via hole 130 is formed on the opposite side of the side at which the coaxial line 100 is connected. Hence, the via hole 130 functions as an open stub of the antenna device 1. When the feeder line 70 transmits high-frequency signals, the reactance component of the via hole 130, which functions as an open stub, leads to the phenomenon of impedance mismatch thereby causing a loss of the high-frequency signals.

In that regard, in the first modification example, the portion corresponding to the via hole 130 is removed using, for example, a drill and the recessed portion 140*a* is formed. With that, no portion of the through hole 20 is allowed to function as an open stub, thereby making it harder to have the phenomenon of impedance mismatch. In this way, one end of the through hole 20, which is formed in a penetrating manner on the substrate 10, and the feeder line 70 are configured to be electrically continuous. Therefore, it becomes possible to reduce the loss of high-frequency signals transmitted by the feeder line 70.

Second Modification Example

Figure 3:
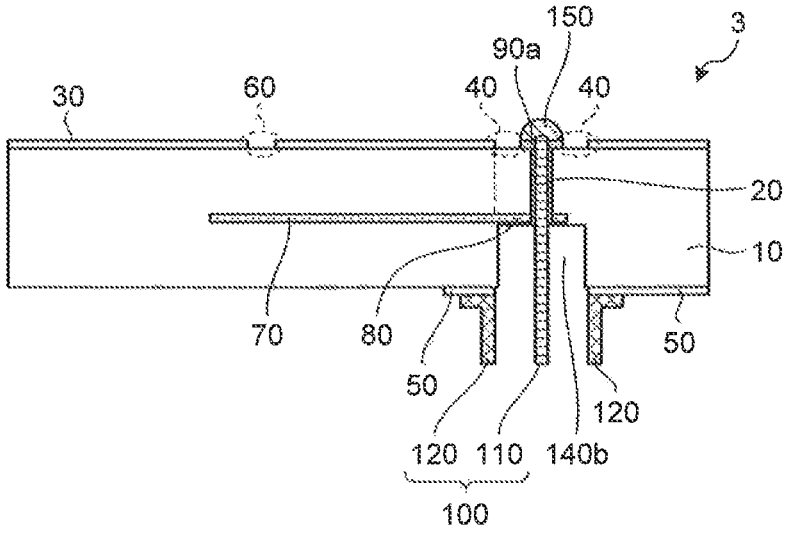
FIG. 3 is a cross-sectional view of an antenna device according to a second modification example of the first embodiment.

Explained below with reference to FIG. 3 is a second modification example of the antenna device 1 according to the first embodiment. In the second modification example, because an antenna device 3 is the same as the antenna device 1 illustrated FIG. 1A, the top view of the antenna device 3 is not illustrated. FIG. 3 is a cross-sectional view of the antenna device 3 along the dashed-dotted line B-B' illustrated in FIG. 1A. Herein, the constituent elements same to the first embodiment are referred to by the same reference numerals, and the relevant explanation is omitted.

As illustrated in FIG. 3, the antenna device 3 according to the second modification example includes a recessed portion 140*b*, which is formed by digging a hole in the second grounded conductor 50 in the thickness direction of the substrate 10. Namely, a hole is formed in the insulation layer formed in between the second layer and the third layer.

Herein, the inner electrical conductor 110 of the coaxial line 100 passes through the inner part of the through hole 20. Moreover, in the land portion 90*a*, the inner electrical conductor 110 and the through hole 20 are connected by a solder 150.

In this way, some portion of the insulation layer, which is formed in between the second layer and the third layer of the substrate 10, is removed using a drill. As a result, it becomes possible to reduce the material loss attributed to the insulation layer.

In the first and second modification examples, the recessed portions 140*a* and 140*b* are formed on two different surfaces of the substrate 10. Alternatively, the recessed portion 140*a* as well as the recessed portion 140*b* may be formed on each of the two surfaces of the substrate 10. In that case, the strength of the substrate 10 may be secured by adjusting the depths of the recessed portions 140*a* and 140*b*.

Second Embodiment

Figure 4A:
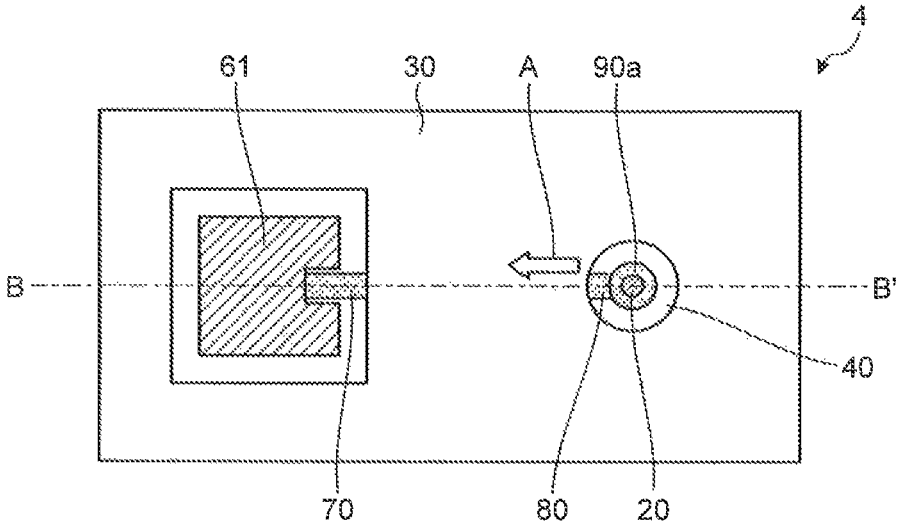
FIG. 4A is a top view of a configuration of an antenna device according to a second embodiment.
Figure 4B:
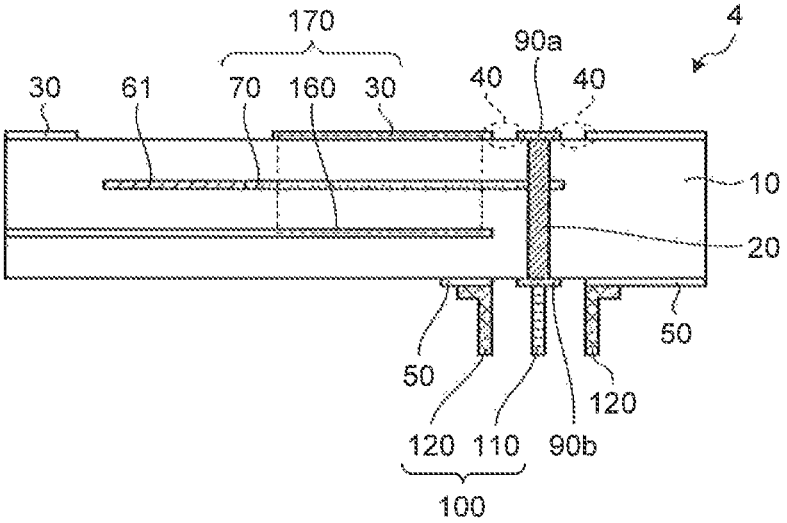
FIG. 4B is a cross-sectional view of the configuration of the antenna device according to the second embodiment.

FIG. 4 is a diagram illustrating a configuration of an antenna device 4 according to a second embodiment. FIG. 4A is a top view of the antenna device 4 according to the second embodiment. FIG. 4B is a cross-sectional view of the antenna device 4 along the dashed-dotted line B-B' illustrated in FIG. 4A.

Regarding the antenna device 4 according to the second embodiment, except for the point that a radiating element 61 is a patch antenna and that a third grounded conductor 160 is further included, the configuration is same to the configuration of the antenna device 1 illustrated in FIG. 1. Hence, the same constituent elements are referred to by the same reference numerals, and the relevant explanation is omitted.

The radiating element 61 is a patch antenna that is substantially quadrangular in shape and has a recessed portion formed on one side. At the recessed portion formed on one side, the radiating element 61 is directly connected to the feeder line 70. Moreover, the radiating element 61 transmits and receives linearly-polarized waves having the plane of polarization parallel to the dashed-dotted line B-B'. The first grounded conductor 30 has a substantially quadrangular hole. The radiating element 61 is formed in the third layer in an area of projection of the quadrangular hole in the thickness direction of the substrate 10.

The third grounded conductor 160 is formed in a fourth layer that is an inner layer of the substrate 10 and is formed in between the second layer and the third layer. In an area illustrated by dotted lines in FIG. 4B, the third grounded conductor 160 along with the first grounded conductor 30 and the feeder line 70 constitutes a stripline 170.

In this way, in the antenna device 4 according to the second embodiment, it becomes possible to achieve the same effect as the effect achieved in the first embodiment. Moreover, as a result of including the third grounded conductor 160 than along with the first grounded conductor 30 and the feeder line 70 constitutes the stripline 170, leakage of radio waves from the feeder line 70 can be prevented even in the case in which the feeder line 70 has electrically-discontinuous portions such as bends or junction. Furthermore, in the antenna device 4, it becomes possible to reduce unwanted emission on the side of the second layer of the substrate 10.

As long as the radiating element 61 in the antenna device 4 transmits and receives linearly-polarized waves having the plane of polarization substantially parallel to the dashed-dotted line B-B', it is possible to have the radiating element 61 in various shapes. As described in the first embodiment, the radiating element 61 may be a slot antenna. Alternatively, the radiating element 61 may be a patch antenna as described in the second embodiment. Moreover, the feeder line 70 may feed electrical power to the radiating element 61 either by means of a directly connection or by means of electromagnetic field coupling. In the antenna device 1 according to the first embodiment too, the same case is applicable.

Third Modification Example

Figure 5A:
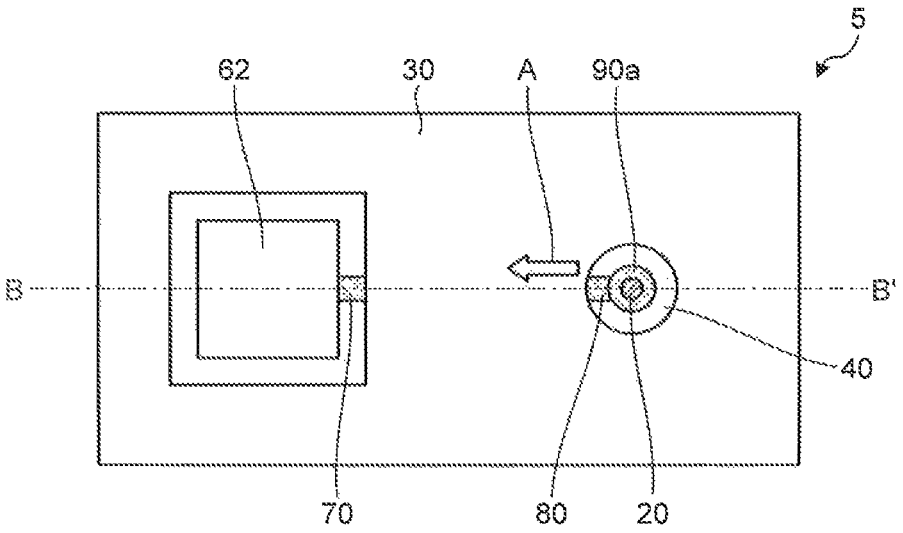
FIG. 5A is a top view of an antenna device according to a third modification example of the second embodiment.
Figure 5B:
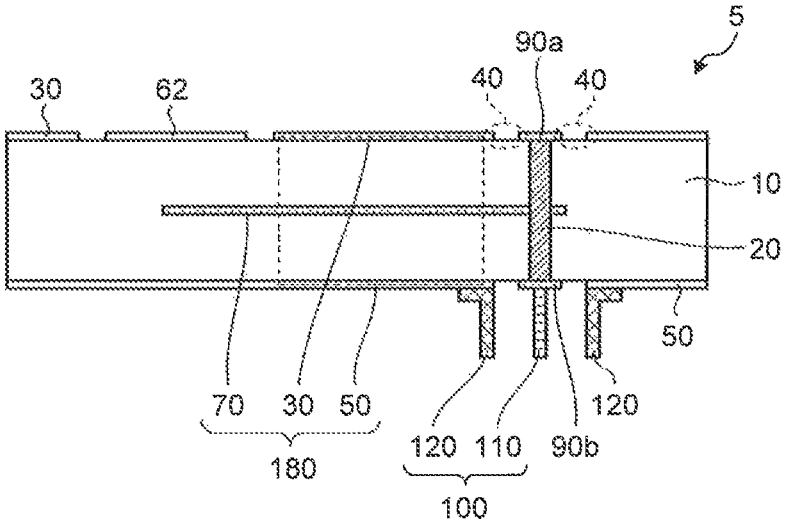
FIG. 5B is a cross-sectional view of the antenna device according to the third modification example of the second embodiment.

Explained below with reference to FIG. 5 is a third modification example of the antenna device 4 according to the second embodiment. FIG. 5A is a top view of an antenna device 5 according to the third modification example. FIG. 5B is a cross-sectional view of the antenna device 5 along the dashed-dotted line B-B' illustrated in FIG. 5A. Herein, the constituent elements same to the second embodiment are referred to by the same reference numerals, and the relevant explanation is omitted.

In the antenna device 5 according to the third modification example, a radiating element 62 is a substantially quadrangular patch antenna. The first grounded conductor 30 has a substantially quadrangular hole, and the radiating element 62 is formed in the first layer and on the inside of that quadrangular hole.

The second grounded conductor 50 is formed in the second layer of the substrate 10 in an area of projection of the feeder line 70 in the thickness direction. In an area illustrated by dotted lines in FIG. 5B, the second grounded conductor 50 along with the first grounded conductor 30 and the feeder line 70 constitutes a stripline 180.

In this way, the stripline 180 can be configured with the first grounded conductor 30, the second grounded conductor 50, and the feeder line 70. As a result of using the second grounded conductor 50 to constitute the stripline 180, the same effect as the effect achieved in the second embodiment can be achieved without having to increase the number of layers in the substrate 10.

Third Embodiment

Figure 6A:
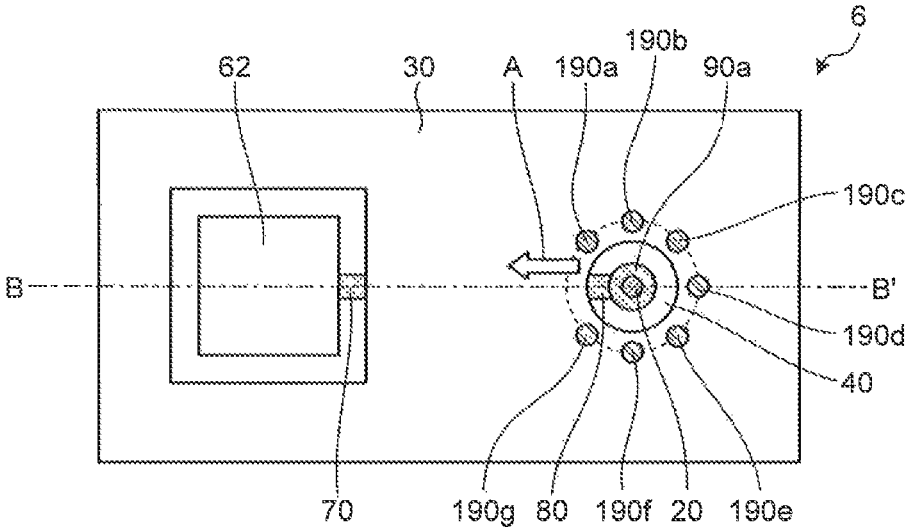
FIG. 6A is a top view of a configuration of an antenna device according to a third embodiment.
Figure 6B:
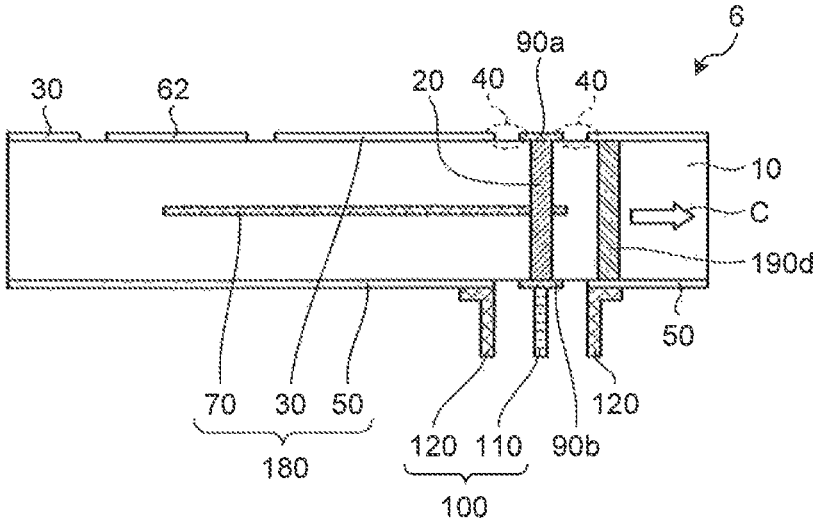
FIG. 6B is a cross-sectional view of the configuration of the antenna device according to the third embodiment.

FIG. 6 is a diagram illustrating a configuration of an antenna device 6 according to the third embodiment. FIG. 6A is a top view of the antenna device 6 according to the third embodiment. FIG. 6B is a cross-sectional view of the antenna device 6 along the dashed-dotted line B-B' illustrated in FIG. 6A. Herein, the constituent elements same to the antenna device 5 according to the third modification example are referred to by the same reference numerals, and the relevant explanation is omitted.

The antenna device 6 includes a plurality of grounded conductors 190*a* to 190*g*, each of which has one end thereof connected to the first grounded conductor 30 and has the other end thereof connected to the second grounded conductor 50. Herein, the grounded conductors 130*a* to 190*g* are through holes arranged in a circular arc around the through hole 20. Moreover, in the portion equivalent to the chord of the circular arc, the feeder line 70 is formed.

As a result of arranging the grounded conductors 190*a* to 190*g* in a circular arc around the through hole 20, a pseudo-coaxial structure is formed in which the through hole 20 functions as the inner electrical conductor and the grounded conductors 190*a* to 190*g* function as outer electrical conductors. As a result, the radio waves do not easily leak in directions other than the direction from the through hole 20 toward the feeder line 70. For example, it becomes possible to prevent the occurrence of a leaking mode in the opposite direction to the direction of the feeder line 70 as indicated by an arrow C in FIG. 6B.

In this way, in the antenna device 6 according to the third embodiment, it becomes possible to achieve the same effect as the effect achieved in the second embodiment. It becomes possible to prevent the occurrence of a leaking mode in directions other than the direction from the through hole 20 toward the feeder line 70. Therefore, it becomes possible to reduce the loss of high-frequency signals transmitted by the feeder line 70.

With reference to FIG. 6, the explanation is given for an example in which the antenna device 6 includes seven grounded conductors 190*a* to 190*g*. However, the number of grounded conductors is not limited to seven. Namely, any number of a plurality of grounded conductors may be used as long as it is possible to prevent the occurrence of a leaking mode in directions other than the direction from the through hole 20 toward the feeder line 70.

Fourth Embodiment

Figure 7A:
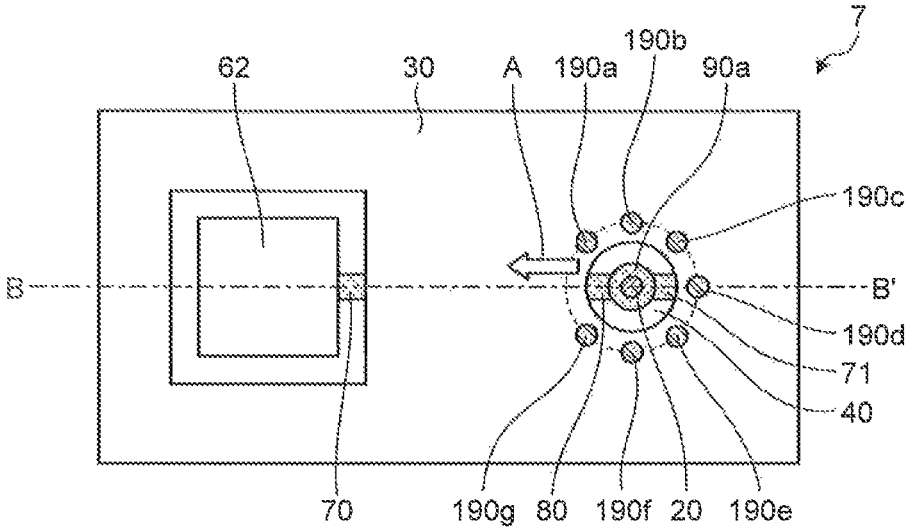
FIG. 7A is a top view of a configuration of an antenna device according to a fourth embodiment.
Figure 7B:
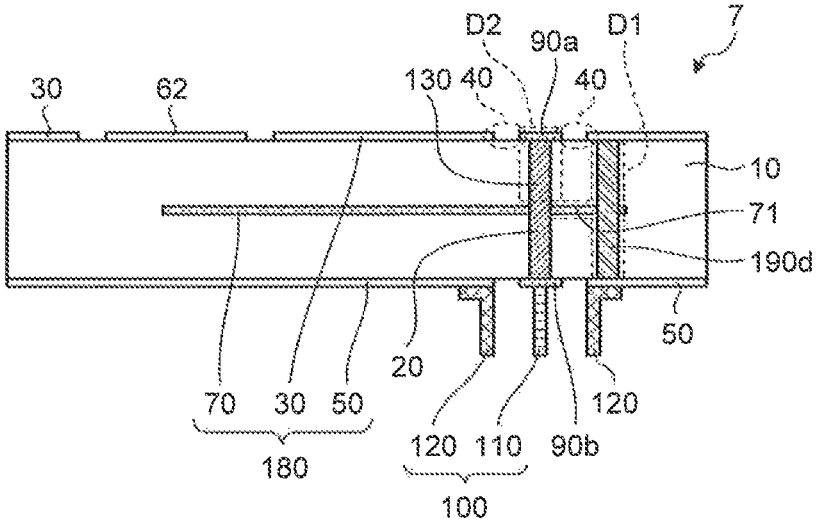
FIG. 7B is a cross-sectional view of the configuration of the antenna device according to the fourth embodiment.

FIG. 7 is a diagram illustrating a configuration of an antenna device 7 according to a fourth embodiment. FIG. 7A is a top view of the antenna device 7 according to the fourth embodiment. FIG. 7B is a cross-sectional view of the antenna device 7 along the dashed-dotted line B-B' illustrated in FIG. 7A. Herein, the constituent elements same to the antenna device 6 according to the third embodiment are referred to by the same reference numerals, and the relevant explanation is omitted.

The antenna device 7 further includes a conductor line 71 that has one end thereof connected to at least one of the grounded conductors 190*a* to 190*g* and has the other end thereof connected to the feeder line 70. With reference to FIG. 7, one end of the conductor line 71 is connected to the grounded conductor 190*d*.

As a result of connecting the grounded conductor 190*d* and the feeder line 70 via the conductor line 71, the conductor line 71 and the grounded conductor 190*d* (an area D1 illustrated by dotted lines in FIG. 7B) function as a short stub. Moreover, as explained in the first modification example too, the via hole 130 illustrated in FIG. 1B (an area D2 illustrated by dotted lines in FIG. 7B) functions as an open stub. In this way, the configuration of the antenna device 7 is such that an open stub and a short stub are added at the junction point of the feeder line 70 and the through hole 20.

Herein, if the via hole 130 functioning as an open stub has the length equal to or smaller than one fourth of the wavelength of the transmitted frequency, then the via hole 130 exhibits a capacitive property. On the other hand, if the conductor line 71 and the grounded conductor 190*d* that function as a short stub have the lengths equal to or smaller than one fourth of the wavelength of the transmitted frequency, then the conductor line 71 and the grounded conductor 190*d* exhibit an inductive property.

In this way, the antenna device 7 has the configuration in which the area D2 representing an open stub and the area D1 representing a short stub are added at the junction point of the feeder line 70 and the through hole 20. As a result, the capacitive property of the open stub and the inductive property of the short stub cancel out each other. That enables achieving reduction in the reactance component attributed to the areas D1 and D2. Hence, it becomes possible to make improvement against the phenomenon of impedance mismatch.

In this way, in the antenna device 7 according to the fourth embodiment, it becomes possible to achieve the same effect as the effect achieved in the third embodiment. It becomes possible to make improvement against the phenomenon of impedance mismatch. That enables achieving reduction in the loss of high-frequency signals transmitted by the feeder line 70.

In the antenna device 7 according to the fourth embodiment, the explanation is given about a case in which one end of the conductor line 71 is connected to the grounded conductor 190*d*. However, alternatively, one end of the conductor line 71 may be connected to any one of the remaining grounded conductors 190*a*, 190*b*, 190*c*, 190*e*, 190*f*, and 190*g*.

Moreover, the antenna device 7 may also be configured to include a plurality of conductor lines 71. In that case, in order to cancel the flow of electricity in the perpendicular direction to the dashed-dotted line B-B'; it is desirable that, with reference to the top view illustrated in FIG. 7A, the conductor lines 71 are arranged in an axisymmetric manner with respect to the dashed-dotted line B-B' serving as the axis.

Fifth Embodiment

Figure 8:
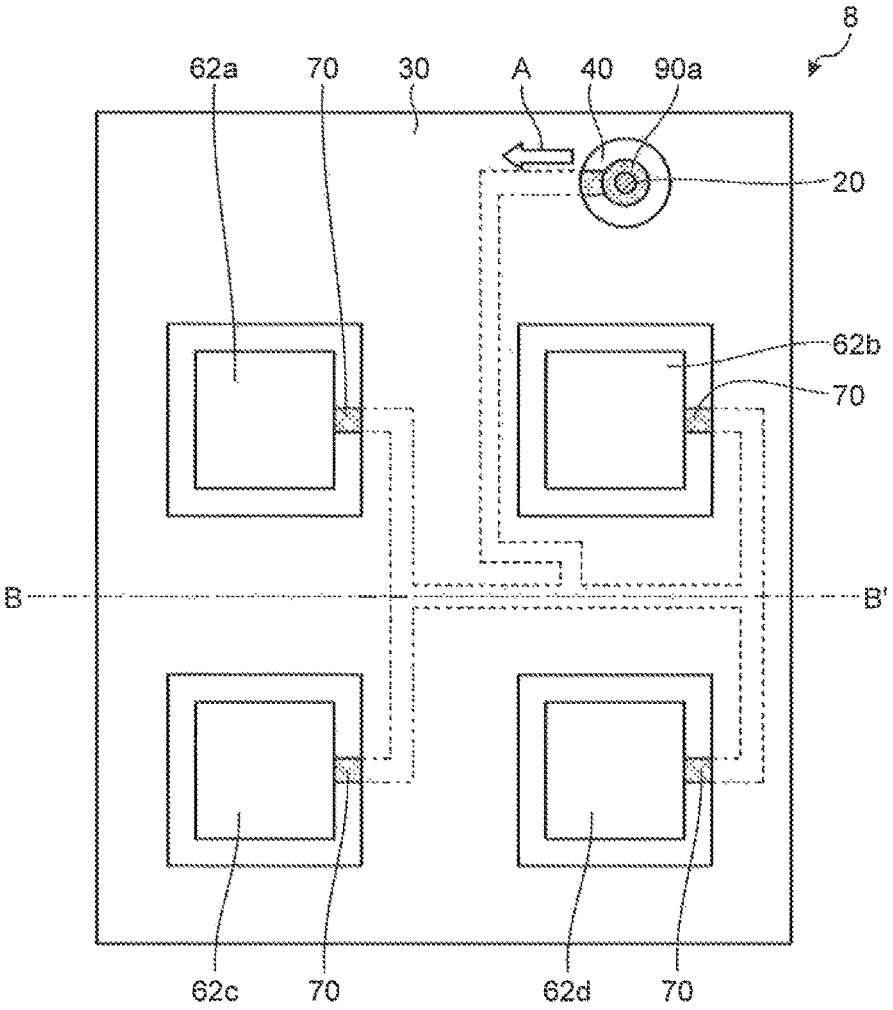
FIG. 8 is a diagram illustrating a configuration of an antenna device according to a fifth embodiment.

FIG. 8 is a diagram illustrating a configuration of an antenna device 8 according to a fifth embodiment. Herein, FIG. 8 is a top view of the antenna device 8 according to the fifth embodiment. Moreover, the constituent elements same to the antenna device 5 according to the third modification example are referred to by the same reference numerals, and the relevant explanation is omitted.

The antenna device 8 includes radiating elements from a first radiating element 62*a* to a fourth radiating element 62*d*. Herein, the first radiating element 62*a* to the fourth radiating element 62*d* have a same configuration to the configuration of the radiating element 62 of the antenna device 5 illustrated in FIG. 5. Hence, the relevant explanation is omitted.

The first grounded conductor 30 has substantially quadrangular holes arranged as a 2×2 matrix in the first layer. The first radiating element 62*a* to the fourth radiating element 62*d* are formed in the first layer and on the inside of the quadrangular holes. Moreover, the first radiating element 62*a* to the fourth radiating element 62*d* are fed with electrical power from the same direction, and transmit or receive linearly-polarized waves having the plane of polarization substantially parallel to the dashed-dotted line B-B'. In this way, the antenna device 8 functions as an array antenna including the first radiating element 62*a* to the fourth radiating element 62*d*.

Herein, for example, consider a case of an antenna system that includes a plurality of array antennas. In such an antenna system, accompanying the number or array antennas, the number of feeder lines 70 also increases. For that reason, there occurs an increase in the radio waves leaking from the feeder lines 70. That has a significant impact on the cross polarization discrimination.

In that regard, if an antenna system is configured using a plurality of antenna devices 8 according to the fifth embodiment, it becomes possible to prevent a decrease in the cross polarization discrimination of each antenna device 8 and to enhance the communication quality of the antenna system.

In this way, in the antenna device 8 according to the fifth embodiment, the plane of polarization of linearly-polarized waves transmitted and received by the first radiating element 62*a* to the fourth radiating element 62*d* is set to be substantially parallel to the straight line 80 of the feeder line 70. As a result, it becomes possible to achieve the same effect as the effect achieved in the second embodiment. Even if the antenna system is configured with a plurality of antenna devices 8, it is possible to enhance the communication quality of the antenna system.

Sixth Embodiment

Figure 9:
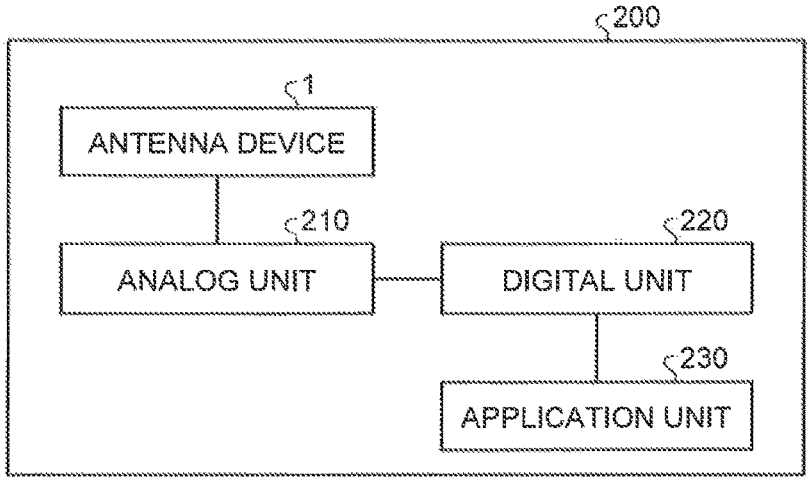
FIG. 9 is a diagram illustrating a configuration of a wireless device according to a sixth embodiment.

FIG. 9 is a diagram illustrating a configuration of a wireless device 200 according to a sixth embodiment. In the wireless device 200 according to the sixth embodiment, the antenna device 1 illustrated in FIG. 1 is installed. Alternatively, it is possible to install the antenna device according to any one of the other embodiments and the modification examples.

The wireless device 200 includes the antenna device 1 and a wireless unit that receives or transmits signals via the antenna device 1. The wireless unit further includes an analog unit 210, a digital unit 220, and an application unit 230.

The analog unit 210 performs analog processing with respect to the signals received via the antenna device 1, and sends the processed signals to the digital unit 220. Moreover, the analog unit 210 performs analog processing with respect to the signals received from the digital unit 220, and sends the processed signals to the antenna device 1.

The digital unit 220 performs digital processing with respect to the signals received from the analog unit 210, and sends the processed signals to the application unit 230. Moreover, the digital unit 220 performs digital processing with respect to the signals received from the application unit 230, and sends the processed signals to the analog unit 210.

The application unit 230 executes various applications. Herein, the application unit 230 executes applications and generates signals, and sends the signals to the digital unit 220. Moreover, the application unit 230 executes applications based on the signals received from the digital unit 220.

In this way, the wireless device 200 according to the sixth embodiment performs communication via the antenna device 1. As a result, it becomes possible to achieve the same effect as the effect achieved according to the first embodiment. The communication quality of the wireless device 200 can also be enhanced.

In the embodiments described above, the explanation is given for a case in which each antenna device performs transmission as well as reception. However, alternatively, each antenna device may be configured to perform either only transmission or only reception. In that case, for example, an antenna device performing transmission and an antenna device performing reception may be installed in a single wireless device in such a way that the planes of polarization of the two antenna devices substantially bisect each other at right angles.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An antenna device comprising:

a substrate that has a through hole, the through hole penetrating the substrate;

a first grounded conductor that is formed in a first layer of the substrate and that has a gap, the gap being positioned between the first grounded conductor and one end of the through hole;

a second grounded conductor that is formed in a second layer of the substrate;

a plurality of radiating elements that are formed on the substrate and that transmit or receive linearly-polarized waves; and a feeder line that is formed between the first layer and the second layer, is electrically continuous with the through hole, and feeds electrical power to the radiating elements, wherein the feeder line includes a straight line that is formed between the first layer and the second layer in an area of projection of the gap in a thickness direction of the substrate and that is formed to be substantially parallel to a plane of polarization of the linearly-polarized waves.

2. The antenna device according to claim 1, further comprising a first land portion that is connected to a first end of the through hole and that is formed on an outer surface of the substrate.

3. The antenna device according to claim 2, further comprising a second land portion that is connected to a second end of the through hole and that is formed on an outer surface of the substrate and on inside of the gap.

4. The antenna device according to claim 2, further comprising a third grounded conductor that is formed in an inner layer of the substrate between the second layer and the feeder line, wherein the first grounded conductor, the feeder line, and the third grounded conductor constitute a stripline.

5. The antenna device according to claim 2, wherein the second grounded conductor is formed in the second layer in an area of projection of the feeder line in the thickness direction; and the first grounded conductor, the feeder line, and the second grounded conductor constitute a stripline.

6. The antenna device according to claim 2, wherein the second grounded conductor is formed in the second layer in an area of projection of the feeder line in the thickness direction; and the first grounded conductor, the feeder line, and the second grounded conductor constitute a stripline.

7. The antenna device according to claim 2, further comprising a plurality of grounded conductors each of which has a first end connected to the first grounded conductor and a second end connected to the second grounded conductor, the plurality of grounded conductors being arranged around the through hole.

8. The antenna device according to claim 1, further comprising a land portion that is connected to one end of the through hole and that is formed on an outer surface of the substrate and on the inside of the gap.

9. The antenna device according to claim 8, further comprising a third grounded conductor that is formed in an inner layer of the substrate between the second layer and the feeder line, wherein the first grounded conductor, the feeder line, and the third grounded conductor constitute a stripline.

10. The antenna device according to claim 8, further comprising a plurality of grounded conductors each of which has a first end connected to the first grounded conductor and a second end connected to the second grounded conductor, the plurality of grounded conductors being arranged around the through hole.

11. The antenna device according to claims 1, further comprising a third grounded conductor that is formed in an inner layer of the substrate between the second layer and the feeder line, wherein the first grounded conductor, the feeder line, and the third grounded conductor constitute a stripline.

12. The antenna device according to claim 11, further comprising a plurality of grounded conductors each of which has a first end connected to the first grounded conductor and a second end connected to the second grounded conductor, the plurality of grounded conductors being arranged around the through hole.

13. The antenna device according to claim 1, wherein the second grounded conductor is formed in the second layer in an area of projection of the feeder line in the thickness direction; and the first grounded conductor, the feeder line, and the second grounded conductor constitute a stripline.

14. The antenna device according to claim 13, further comprising a plurality of grounded conductors each of which has a first end connected to the first grounded conductor and a second end connected to the second grounded conductor, the plurality of grounded conductors being arranged around the through hole.

15. The antenna device according to claim 1, further comprising a plurality of grounded conductors each of which has a first end connected to the first grounded conductor and a second end connected to the second grounded conductor, the plurality of grounded conductors being arranged around the through hole.

16. The antenna device according to claim 15, further comprising a conductor line that has one end connected to at least one of the plurality of grounded conductors and has other end thereof connected to the feeder line.

17. The antenna device according claim 1, further comprising a second radiating element that is formed on the substrate and that transmits or receives the linearly-polarized waves.

18. The antenna device according to claim 1, wherein the feeder line has a plurality of bent parts.

19. A wireless device comprising:

an antenna that includes a substrate that has a through hole, the through hole penetrating the substrate;

a first grounded conductor that is formed in a first layer of the substrate and that has a gap, the gap being positioned between the first grounded conductor and one end of the through hole;

a second grounded conductor that is formed in a second layer of the substrate;

a plurality of radiating elements that are formed on the substrate and that transmit or receive linearly-polarized waves; and a feeder line that is formed between the first layer and the second layer, is electrically continuous with the through hole, and feeds electrical power to the radiating elements; and a wireless unit that transmits or receives signals via the antenna, wherein the feeder line includes a straight line that is formed between the first layer and the second layer in an area of projection of the gap in a thickness direction of the substrate and that is formed to be substantially parallel to a plane of polarization of the linearly-polarized waves.

* * * * *